United States Patent [19]

Willoughby

[11] Patent Number: 4,512,119

[45] Date of Patent: Apr. 23, 1985

[54] APPARATUS FOR ROOF FLASHING

[75] Inventor: John C. Willoughby, Victoria, Australia

[73] Assignees: Foam-Lag Industries Pty. Ltd.; P.C.H. Constructions Pty. Ltd., both of Victoria, Australia

[21] Appl. No.: 522,743

[22] Filed: Aug. 12, 1983

[30] Foreign Application Priority Data

Aug. 13, 1982 [AU] Australia ..... PF5379
Sep. 24, 1982 [AU] Australia ..... PF6050

[51] Int. Cl.[3] ..... E04D 13/14

[52] U.S. Cl. ..... 52/58; 52/94; 285/43

[58] Field of Search ..... 52/58–60, 52/94–96; 285/42, 43, 161

[56] References Cited

U.S. PATENT DOCUMENTS

| | | | |
|---|---|---|---|
| 969,476 | 9/1910 | Holt | 285/43 |
| 1,299,423 | 4/1919 | Bropson | 285/42 |
| 1,626,808 | 5/1927 | Gibson | 285/43 |
| 2,705,542 | 4/1955 | Yavicth | 285/42 |
| 3,181,899 | 5/1965 | McKnight | 285/161 |
| 3,977,137 | 8/1976 | Patry | 52/58 |

*Primary Examiner*—James L. Ridgill, Jr.
*Attorney, Agent, or Firm*—Dennison, Meserole, Pollack & Scheiner

[57] ABSTRACT

Apparatus for flashing rooves, particularly inclined rooves, around vent pipes or the like using a relatively thin sheet of material to surround the pipe (10) and form part of the roof. The apparatus comprises an inner sleeve member (12) adapted to fit over the pipe (10) and pass through a hole in said sheet which accommodates the pipe. The sleeve (17) has an inclined flange (13) which bears on the underside of said sheet (11). A further similar sleeve (16) is adapted to fit over the inner sleeve (12). The outer sleeve (16) has a flange (17) which bears on the upper surface of the sheet (11) and a locking cap (18) threadably engages the upper end of said inner sleeve (12) in a manner forcing the outer sleeve (16) downwardly such that the two flanges (13, 17) clamp the sheet therebetween. An annular rubber washer is provided for insertion between the flange (17) and the sheet (11) to form a weather seal and a neoprene weather apron (19) is provided to slide over the pipe (10) in resilient engagement therewith to provide weather protection over said locking cap (19). The apparatus avoids the need for using relatively thick lead sheets in roof flashing and also saves time in installation.

12 Claims, 1 Drawing Figure

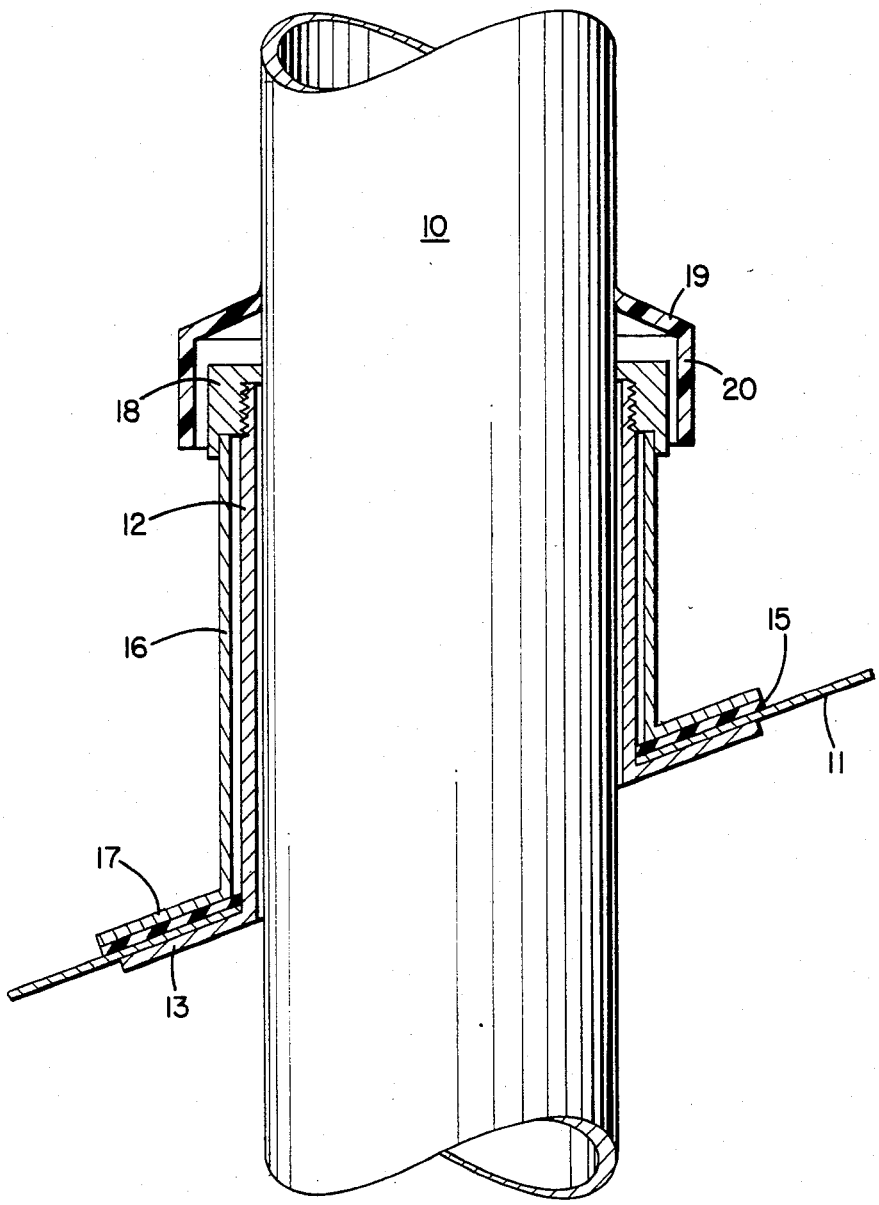
10
19
20
18
12
16
15
11
17
13

APPARATUS FOR ROOF FLASHING

The present invention relates to roof flashing and in particular to a method and apparatus for flashing rooves around vent pipes and the like, to form a weather seal where such pipes pass through a roof.

Conventionally such flashing is achieved using a sheet of malleable material, usually lead, through which a hole is made for the pipe. The edge of the material around the hole is "dressed" in an upwardly extending sleeve using a dressing tool so as to fit closely around the pipe and the sheet of material is located in a roof to replace one or more roof tiles. Once the sheet is in position with the pipe passing therethrough a weather apron is affixed to the pipe. In more recent times the pipe and weather apron are made from PVC and affixed using a solvent cement whereas previously the pipe and weather apron were generally formed from galvanized iron and were affixed by soldering.

A problem with the aforementioned conventional method is that they are relatively expensive both in materials and labour. The lead sheet needs to be 3 lb/sq. ft. lead in order to provide enough material for dressing and is therefore relatively expensive to purchase. Furthermore, it is time consuming to perform the dressing operation and a special tool is required.

Accordingly, it is an object of this invention to provide an improved method and apparatus for flashing rooves around vent pipes and the like, which avoids or at least reduces the aforementioned problem of conventional methods.

The invention therefore provides apparatus for flashing rooves around vent pipes or the like wherein a relatively thin sheet of material is adapted to surround said vent pipe or the like and form part of the roof, said sheet being provided, in use, with a hole through which said pipe passes, characterized in that, said apparatus includes an inner sleeve member adapted to fit over said pipe and pass through said hole and having an annular flange for engaging the underside of said sheet, an outer sleeve member of similar shape to said inner sleeve member and adaptd to fit over said inner sleeve member, said outer sleeve member having an annular flange for engaging the upper side of said sheet, and a locking cap adapted for attachment to an upper end of said inner sleeve member in a manner applying a force on an upper end of said outer sleeve so as to force said respective flanges towards each other in a manner clamping said sheet therebetween.

In order that the invention may be more readily understood, one particular embodiment will now be described with reference to the accompanying drawing wherein the sole FIGURE is a sectional side elevation of an apparatus for flashing rooves around vent pipes.

In the drawing, there is shown part of a vent pipe 10 in the area where it would pass through a roof surface. The apparatus for flashing the roof includes a thin aluminium sheet 11 which is used to replace a concrete or ceramic roof tile in the same manner as a lead sheet used in the past. The aluminium sheet is provided with a hole already cut therethrough although in an alternative the hole is cut on site. The purpose of the hole is to facilitate passage of the vent pipe 10. Before locating the aluminium sheet in position in the roof, an inner sleeve member 12 is slid over the vent pipe 10 such that a flange 13 thereon will be located against the underside of the aluminium sheet 11. The aluminium sheet 11 is then placed in position and an annular rubber washer 15 is placed over the inner sleeve member 12 and slid downwardly to rest on the top of the aluminium sheet 11. Once the rubber washer 15 is placed in position an outer sleeve member 16 is slid downwardly over the inner sleeve member 12 such that a flange 17 thereon bears against the rubber washer 15.

When both sleeve members 12 and 16 are in position a locking cap 18 is slid downwardly over the vent pipe 10 and is threadably engaged with the upper end of the inner sleeve member 12. The locking cap 18 has a downwardly depending annular groove around the outer perimeter thereof for engaging the upper end of the outer sleeve member 16. By rotating the locking cap onto the inner sleeve member 12, the annular groove causes the locking cap to apply a downward force on the outer sleeve member 16 forcing the flange thereof towards the flange 13 of the inner sleeve member 12. The result is that the rubber washer 15 is forced against the aluminium sheet to provide a good weather seal.

It will be noted from the drawing that the flanges 13 and 17 are inclined with respect to the longitudinal axes of the respective sleeve members. According to this embodiment the angle of inclination is about 25° as this is considered a good compromise for enabling the apparatus to be used on most rooves. Generally the angle of inclination of a roof is somewhere between about 17° and about 35° and an angle of 25° inclination of the flanges enables the apparatus to be used in such a range of rooves because the aluminium sheet 10 is able to flex sufficiently to account for any variation in angle of inclination between the flanges and the actual roof.

Whilst the locking cap 18 may be a close fit over the vent pipe 10, it is necessary to provide a weather seal to prevent any water which runs down the vent pipe 10 from entering the underside of the roof. Thus a neoprene weather apron 19 is provided for this purpose. The weather apron 19 resiliently engages the outer surface of the vent pipe 10 and is slid downwardly thereover to a position where a downwardly depending skirt 20 of the apron 19 is over the locking cap 18 and thus protects the upper ends of the sleeve members 12 and 16 from the ingress of water. The weather apron 19 may be provided without a hole to accommodate the vent pipe 10 and such a hole may be cut on site by the user. This enables a common apron 19 to be used for a range of pipe sizes within certain limitations.

The apparatus of the above described embodiment is formed essentially from PVC. In other words, both the inner and outer sleeve members 12 and the locking cap 18 are of PVC whilst the other components are formed from the materials previously indicated. Since vent pipes are of varying sizes it is necessary to provide different kits of apparatus to take into account the wide variation in vent pipe sizes. The aluminium sheet 11 may be provided with a hole therethrough which accounts for various sizes of vent pipes provided the variation is not too great. Alternatively, as mentioned above the hole may be cut on site as with the weather apron 19 in which case one particular kit can be used for various pipe sizes at least within the range of variation which occurs between galvanized iron PVC and copper pipes of the same nominal diameter. Similarly, the rubber washer 15 may be provided in a size which is suitable for various sizes of vent pipe 10.

Whilst one particular embodiment has been described above, it is conceivable that variations may be readily effected without departing from the scope of the invention. For example, the neoprene weather apron 19 may be a more conventional PVC weather apron as has been used in the past although such is only suitable for PVC vent pipes and must be the exact size for the pipe. As another example, the locking cap 18 may be attached to the inner sleeve member 12 by means other than a screw attachment such as for example a clip-on attachment although at the present time a screw attachment is preferred.

It should be readily apparent to persons skilled in the art that the present invention has considerable advantages over the existing apparatus for flashing rooves. Whilst a number of components are involved, the overall cost of materials is considerably less than the cost of a lead sheet as previously used. Furthermore, since installation of the apparatus is much quicker and easier than with the prior apparatus due to the fact that it is not necessary to use a special tool to dress the lead sheet the time involved in installation is far less. Thus, the savings in material and labour create a considerable saving in the overall cost of flashing a roof around a vent pipe or the like. Whilst the above described embodiment utilizes an aluminium sheet a 2 lb/sq. ft. or even 1 lb/sq. ft. lead sheet could be utilized since it is not necessary to dress or form the sheet up around the pipe and therefore the extra material of a 3 lb/sq. ft. sheet is not required. Of course an aluminium sheet is far less expensive than even the lighter weight lead sheets and is thus preferred.

Since it is envisaged that the apparatus will be sold in kit form it is conceivable that only the inner and outer sleeves 12 and 16 and the locking cap 18 will be provided along with perhaps the rubber washer 15. The remainder of the apparatus, that is, the sheet of material 11 and the weather apron 19 is apparatus which is generally used by plumbers for other purposes and is readily on hand. Thus for convenience in packaging at least the sheet 11 would probably be omitted from the kit although in some instances the weather apron 19 may be included. According to another modification a second rubber washer similar to the washer 15 may be provided for insertion on the underside of the sheet 11 between the sheet and the flange 13 of the inner sleeve 12 although in most cases the need for this further washer is felt to be unjustifiable.

I claim:

1. Apparatus for flashing roofs around pipes using a relatively thin sheet of material engageable about said pipe to form part of the roof, said sheet being provided, in use, with a hole through which said pipe passes; said apparatus including an inner sleeve member fitting over said pipe and passing through said hole and having an annular flange engaging the underside of said sheet, an outer sleeve member fitting over said inner sleeve member, said outer sleeve member having an annular flange engaging the upper side of said sheet and a locking cap attached to an upper end of said inner sleeve member in a manner engaging and applying a force on an upper end of said outer sleeve so as to force said respective flanges toward each other in a manner clamping said sheet therebetween.

2. Apparatus according to claim 1, further comprising an annular sealing washer located between said sheet and said flange of said outer sleeve member to provide a waterproof seal when said apparatus is assembled.

3. Apparatus according to claim 2, further comprising a weather apron fitting sealingly around said pipe and having a downwardly depending skirt covering the upper ends of said sleeves and said locking cap.

4. Apparatus according to claim 3, wherein said attachment of said locking cap to said upper end of said inner sleeve member is a screw thread arrangement which enables said cap to be tightened to bear down on said upper end of said outer sleeve for applying said force, said cap having a downwardly directed annular recess accommodating said upper end of said outer sleeve.

5. Apparatus according to claim 4, wherein said flanges are inclined at an angle to the longitudinal axis of the respective sleeves so as to conform more or less with the slope angle of an inclined roof.

6. Apparatus according to claim 5, wherein said thin sheet of material is in the form of an aluminium sheet.

7. Apparatus according to claim 6, wherein said weather apron is formed of neoprene and has a conical portion through which a hole is made to accommodate said pipe, said hole being of a slightly smaller diameter than the outside diameter of said pipe whereby said apron resiliently engages said pipe, said skirt depending from said conical portion.

8. Apparatus for flashing roofs around pipes using a relatively thin sheet of material having an underside and an upper side and being adapted to surround a pipe to form part of a roof, said sheet being provided, in use, with a hole through which said pipe passes; said apparatus including an inner sleeve member adapted to fit over said pipe and pass through said hole, said inner sleeve member having an annular flange engagable against the underside of said sheet, an outer sleeve member adapted to fit over said inner sleeve member, said outer sleeve member having an annular flange engagable against the upper side of said sheet, and means for fixing said sleeve members together with the respective flanges forced toward each other for clamping said sheet therebetween.

9. Apparatus according to claim 8 further comprising an annular sealing washer locatable between said sheet and the flange of said outer sleeve member for providing a waterproof seal upon assembly of said apparatus.

10. Apparatus according to claim 9 further comprising a weather apron adapted to fit sealingly around said pipe, said apron having a downwardly depending skirt positionable over upper ends of the assembled sleeve members.

11. Apparatus according to claim 10 wherein said flanges are inclined at an angle to the longitudinal axis of the respective sleeve members for general conformance with the slope angle of an inclined roof.

12. Apparatus according to claim 10 wherein said weather apron is formed of neoprene and includes a conical portion with an aperture therethrough adapted for the accommodation of said pipe therethrough with the conical portion in intimate engagement with said pipe, said skirt depending from said conical portion for positioning in surroundng relation to said pipe and at least a portion of the assembled sleeve members.

* * * * *